United States Patent [19]

Suzuki

[11] Patent Number: 5,018,426

[45] Date of Patent: May 28, 1991

[54] HI-HAT STAND APPARATUS FOR SUPPORTING A PAIR OF CYMBALS

[75] Inventor: Seiji Suzuki, Kawaguchi, Japan

[73] Assignee: Pearl Musical Instrument Co., Tokyo, Japan

[21] Appl. No.: 545,470

[22] Filed: Jun. 28, 1990

[30] Foreign Application Priority Data

Dec. 28, 1989 [JP] Japan ..... 1-152969

[51] Int. Cl.[5] ..... G10D 13/00

[52] U.S. Cl. ..... 84/422.3

[58] Field of Search ..... 84/422.1–422.4

[56] References Cited

U.S. PATENT DOCUMENTS 4,691,613 9/1987 Jacobson ..... 84/422.1
4,846,040 7/1989 Hoshino ..... 84/422.3
4,890,532 1/1990 Carlson ..... 84/422.1
4,905,565 3/1990 Hoshino ..... 84/422.3

*Primary Examiner*—Lawrence R. Franklin
*Attorney, Agent, or Firm*—Frishauf, Holtz, Goodman & Woodward

[57] ABSTRACT

An elevator rod is passed through a hollow post. A lower cymbal is mounted on the upper end of the post, while an upper cymbal is mounted on the upper portion of the rod. The elevator rod is urged upward by a return spring. A running pulley is mounted on the lower end portion of the rod. The running pulley is rotatable around a horizontal support shaft. A foot board is disposed at a position lower than the pulley, and a flexible member is wound around the pulley. A fixed end of the flexible member is connected to a supporting portion which is situated lower than the running pulley. A free end of the flexible member is connected to the extreme end portion of the foot board.

8 Claims, 5 Drawing Sheets

HI-HAT STAND APPARATUS FOR SUPPORTING A PAIR OF CYMBALS

BACKGROUND OF THE INVENTION

1. Field of the Invention

The present invention relates to a hi-hat stand apparatus for supporting upper and lower cymbals, and more particularly, to an improvement of means for driving the upper cymbal.

2. Description of the Related Art

A hi-hat stand apparatus comprises a hollow post and an elevator rod passed through the post. The upper end portion of the rod projects upward from a top opening of the post. The rod is urged upward by a return spring. The lower end of the elevator rod is connected to the extreme end of a foot board by means of a connecting member, such as a chain or belt.

In the hi-hat stand apparatus constructed in this manner, a lower cymbal is mounted on the upper end of the post, while an upper cymbal is mounted on the upper end portion of the elevator rod. If a player treads the foot board to work it, the rod descends, so that the upper cymbal strikes against the lower cymbal. If the player lifts his or her foot off the foot board, the upper cymbal is raised by the elastic force of the return spring.

The performance characteristic of the hi-hat cymbal apparatus depends on the ease of depression of the foot board and the response of the upper cymbal which ascends when the player's foot is lifted off. In other words, the foot board should be able to be softly worked, and the upper cymbal should be able to return quickly, for a satisfactory footwork for a performance.

The foot board can be made to be able to be softly worked by reducing the spring constant of the return spring. If the spring constant of the return spring is made smaller, however, the force to raise the elevator rod weakens, so that the returning action of the upper cymbal slows down. If the spring constant is made greater, on the other hand, a greater force is required to work the foot board.

SUMMARY OF THE INVENTION

Accordingly, the object of the present invention is to provide a hi-hat stand apparatus, in which a foot board can be worked with a small force, and an upper cymbal can be quickly returned.

In order to achieve the above object, a hi-hat stand apparatus according to the present invention comprises: a hollow post having an open upper end portion, an open lower end portion, and a through hole extending between the two end portions, the post having a lower cymbal mounted on the upper end portion thereof; an elevator rod passed through the through hole of the hollow post, the rod having upper and lower end portions, the upper end portion of the rod projecting upward from the upper end portion of the hollow post and being fitted with an upper cymbal; return means for urging the elevator rod to ascend; stopper means for restraining the upper limit position of the elevator rod to prevent the rod from ascending above a predetermined height; a frame having a pair of vertically extending side wall portions and a horizontally extending portion; a foot board having first and second end portions, the first end portion being supported by the horizontally extending portion of the frame, the second end portion being situated higher than the first end portion; a horizontal support shaft situated between the pair of side wall portions of the frame and adapted to move in the vertical direction in association with the elevator rod; a running guide member rotatably supported by means of the support shaft, the guide member being adapted to ascend and descend together with the elevator rod and situated higher than the second end portion of the foot board; a flexible member having a fixed end, a free end, and an intermediate portion situated between the two ends, the free end being connected to the second end portion of the foot board, the intermediate portion being curved in the form of an inverted U and wound around the upper half of the running guide member; and supporting means for supporting the fixed end of the flexible member, the supporting means being situated lower than the running guide member and immovable with respect to the frame.

According to the present invention, the foot board can be worked with a force about half as large as the elastic force of the return means or spring. Thus, even though the spring constant of the return spring used is greater than in the case of a conventional apparatus, the foot board can be worked with a relatively small force. Since the return spring with a great spring constant can be used, moreover, the upper cymbal can be quickly returned.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

One embodiment of the present invention will now be described with reference to the accompanying drawings of FIGS. 1 to 5.

Figure 1:
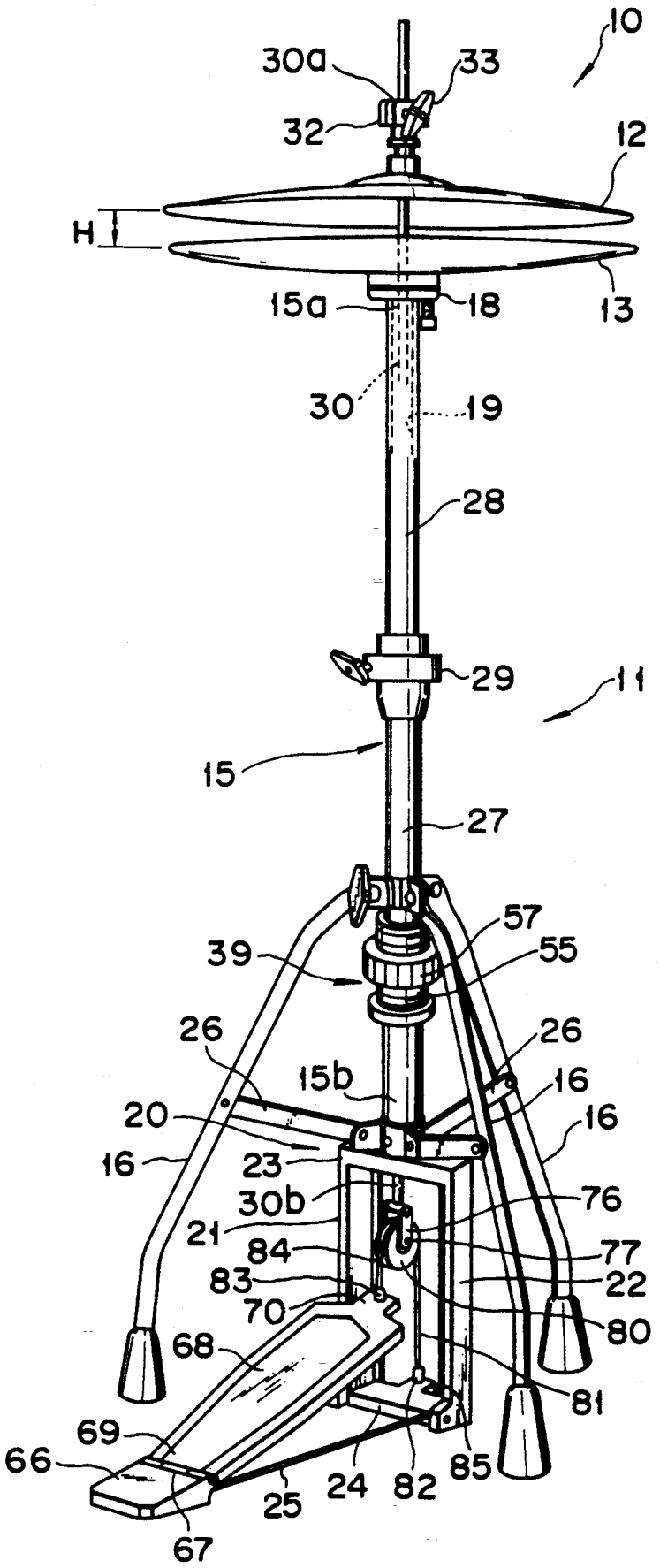
FIG. 1 is a perspective view of a hi-hat stand apparatus according to one embodiment of the present invention.
Figure 2:
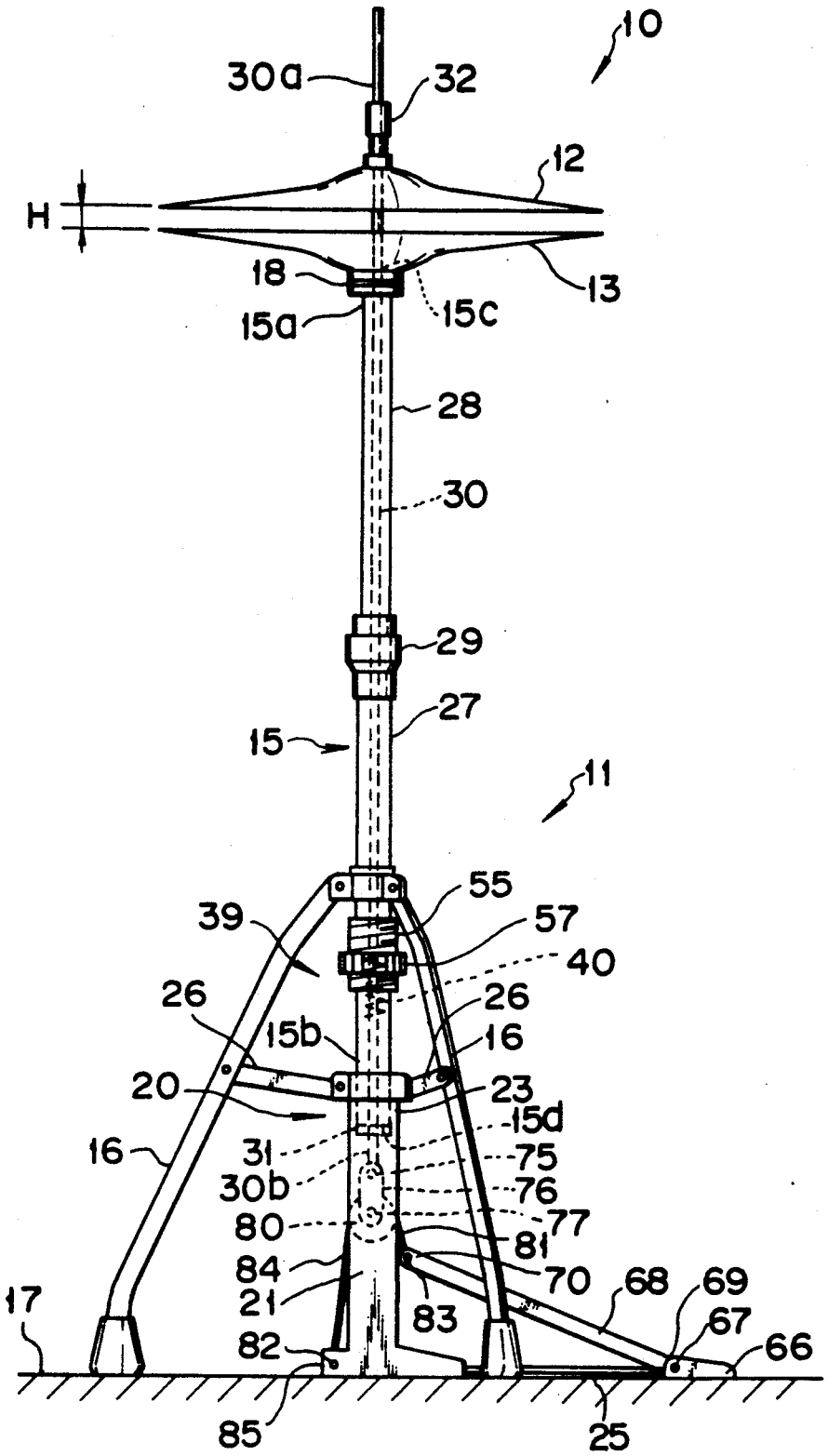
FIG. 2 is a side view of the stand apparatus shown in FIG. 1.

A hi-hat cymbal instrument 10 shown in FIG. 1 comprises a hi-hat stand apparatus 11 and a pair of cymbals 12 and 13 arranged at the upper portion of the apparatus 11.

The hi-hat stand apparatus 11 comprises a hollow post 15, which is supported substantially vertically on a floor 17 by means of three legs 16. The lower cymbal 13 is mounted on an upper end portion 15*a* of the post 15 by means of a cymbal fixing member 18. The post 15 has a through hole 19 extending therein between two opposite end portions 15*a* and 15*b*.

A frame 20, which is disposed under the hollow post 15, is set on the floor 17. The frame 20 includes a pair of side wall portions 21 and 22, an upper wall portion 23, a lower wall portion 24, and a horizontally extending rod-shaped sub-frame 25. The sub-frame 25 projects in front of the frame 20, that is, toward a cymbal player. The sub-frame may be plate-shaped. The lower end portion 15*b* of the post 15 is fixed to the upper wall portion 23. The lower end portion 15*b* of the post 15 and the legs 16 are connected by means of stays 26.

The hollow post 15 includes a lower pipe 27 and an upper pipe 28. The outside diameter of the upper pipe 28 is smaller than the inside diameter of the lower pipe 27. The lower portion of the upper pipe 28 is inserted in the lower pipe 27 for axial movement. The upper pipe 28 can be fixed at a desired height relative to the lower pipe 27 by means of a clamp mechanism 29.

An elevator rod 30 is inserted in the through hole 19 of the hollow post 15 for axial movement. The rod 30 is prevented from ascending above a predetermined height by a stopper 31 shown in FIG. 2. An upper end portion 30*a* of the rod 30 projects above the post 15 through an upper end opening 15*c* of the post. A lower end portion 30*b* of the rod 30 projects below the post 15 through a lower end opening 15*d* of the post.

The upper cymbal 12 is mounted on the upper end portion 30*a* of the elevator rod 30 by means of a cymbal fitting 32. The fitting 32 is provided with a clamp screw 33. When the screw 33 is loosened, the cymbal fitting 32 can be vertically moved with respect to the rod 30. Thus, the distance H from the lower cymbal 13 to the upper cymbal 12 can be adjusted.

Figure 3:
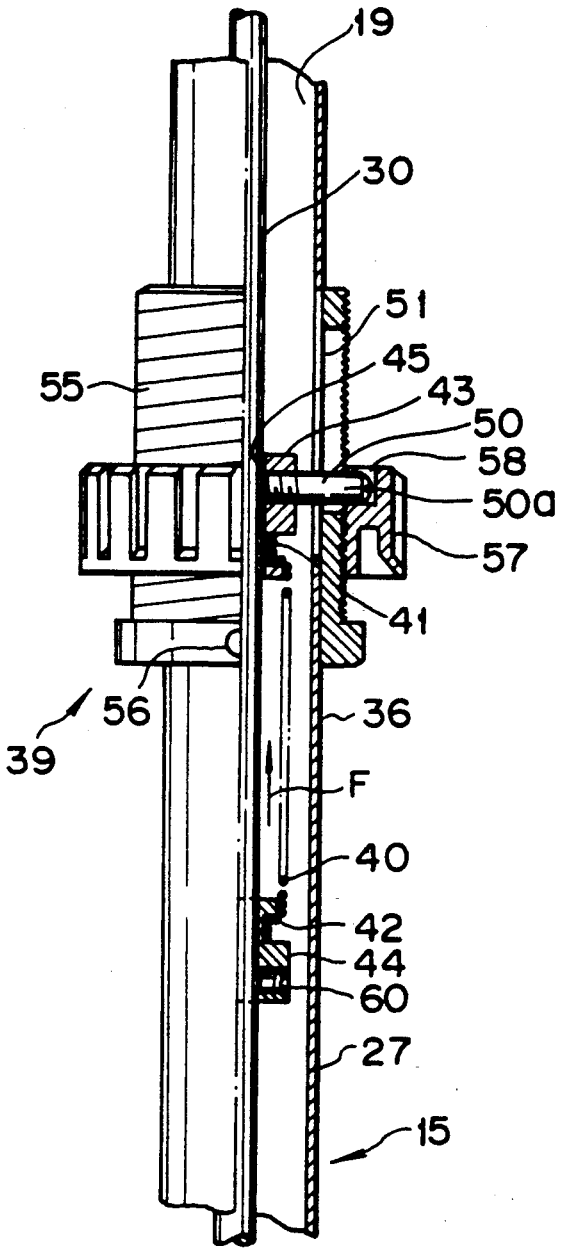
FIG. 3 is a side view, partially in section, showing a return mechanism in the stand apparatus of FIG. 1.

A return mechanism 39 is mounted on the hollow post 15. As shown in FIG. 3, the mechanism 39 includes a tension spring 40. The spring 40, which is located in the lower pipe 27 of the post 15, serves as a return spring for raising the elevator rod 30. The spring 40 has first and second ends 41 and 42. First and second retainers 43 and 44 are fixed to the first and second ends 41 and 42, respectively. A hole 45 vertically penetrates the central portion of the first retainer 43. The rod 30 is passed through the hole 45 for axial movement.

A pin 50 protrudes horizontally from the first retainer 43. An end portion 50*a* of the pin 50 projects outside the pipe 27, extending through an longitudinal slot 51 of the pipe 27. An adjusting bolt 55 is fixed to the middle portion of the pipe 27, with respect to the longitudinal direction, by means of a setscrew 56. A nut 57 is threadedly engaged with the bolt 55. An annular groove 58 is formed on the upper surface of the nut 57 so as to be concentric with the pipe 27. The end portion 50*a* of the pin 50 is located in the groove 58. When the nut 57 is rotated, its height relative to the adjusting bolt 55 changes. Thus, the height of the pin 50, i.e., the height of the first retainer 43, can be changed.

The second retainer 44 is fixed to the elevator rod 30 by means of a setscrew 60. Accordingly, the elastic force of the spring 40 urges the rod 30 to ascend. Since the rod 30 is prevented from ascending above the predetermined height by the stopper 31, the initial tension F of the spring 40 can be adjusted by changing the height of the first retainer 43.

A heel piece 66 is provided at the extreme end of the sub-frame 25. The piece 66, which has a horizontal hinge 67, is set on the floor 17.

A foot board 68 is supported for vertical rocking motion by means of the hinge 67. A first end portion 69 of the board 68 is pivotally mounted on the hinge 67. A second end portion 70 of the board 68 is lifted above the floor 17, that is, it is situated higher than the first end portion 69.

A link 76 is attached to the lower end portion 30*b* of the elevator rod 30 by means of a horizontal shaft 75. The link 76, which is situated higher than the second end portion 70 of the foot board 68, can swing back and forth around the shaft 75. A horizontal support shaft 77 is provided at the lower portion of the link 76.

A pulley-shaped running guide member 80 is mounted on the link 76 by means of the support shaft 77. The guide member 80, which can rotate around the shaft 77, is situated higher than the second end portion 70 of the foot board 68. Also, the member 80 vertically moves in one with the elevator rod 30.

A flexible member 81 is wound around the running guide member 80. The member 81 may be formed of a wire rope or fiber rope. A belt may be used in place of the rope. The flexible member 81 has a fixed end 82, a free end 83, and an intermediate portion 84 situated between the ends 82 and 83. The fixed end 82 of the member 81 is connected to a supporting portion 85 which is situated lower than the running guide member 80. Although the supporting portion 85 is located at the lower portion of the frame 20 in this embodiment, it may alternatively be provided on any other member than the frame 20. For example, an arm portion (not shown) may be formed extending under the post 15 so that the fixed end 82 of the flexible member 81 is connected to the arm portion.

The free end 83 of the flexible member 81 is connected to the second end portion 70 of the foot board 68. The intermediate portion 84 of the member 81 is curved in the form of an inverted U, and is wound around the upper half of the running guide member 80.

The following is a description of the operation of the hi-hat stand apparatus 11.

Figure 5:
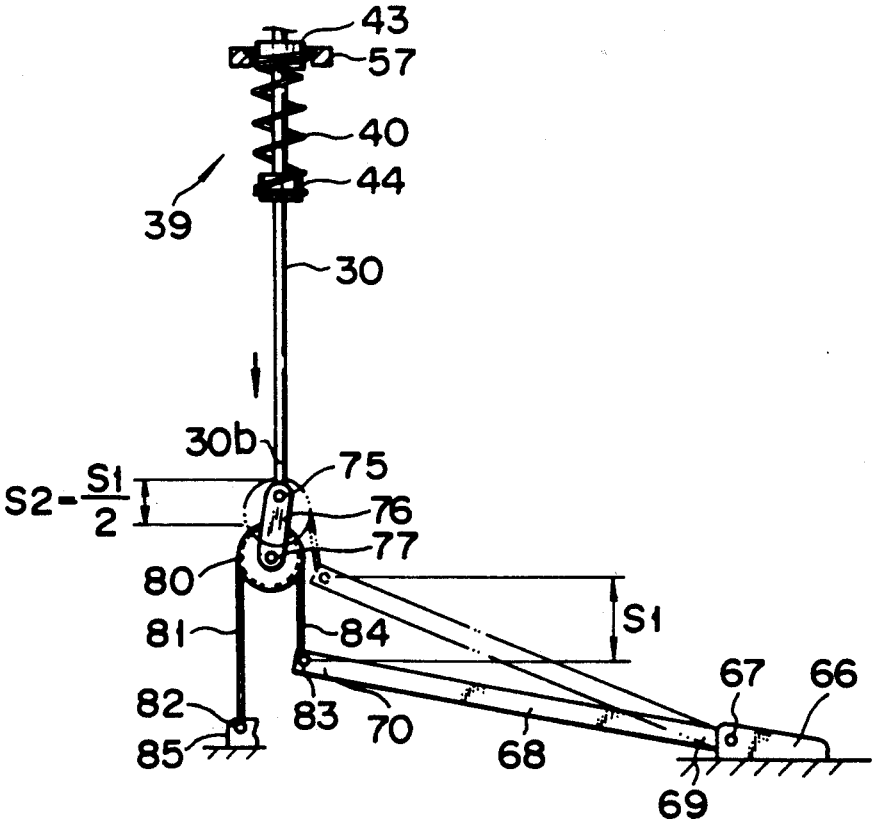
FIG. 5 is a side view showing a state in which a foot board of the stand apparatus of FIG. 1 is worked.

When the foot board 68 is worked, the free end 83 of the flexible member 81 is pulled downward, so that the running guide member 80 and the elevator rod 30 descend, as shown in FIG. 5. When the rod 30 descends in this manner, the upper cymbal 12 abuts against the lower cymbal 13, thereby producing a sound. The shift stroke S2 of the guide member 80 is about half the shift stroke S1 of the end portion 70 of the foot board 68. The member 80 can, however, pull down the rod 30 with a force twice as great as one applied to the board 68. Even though the spring constant of the return spring 40 is greater than in the case of the conventional apparatus, therefore, the board 68 can be worked with a relatively small force.

Figure 4:
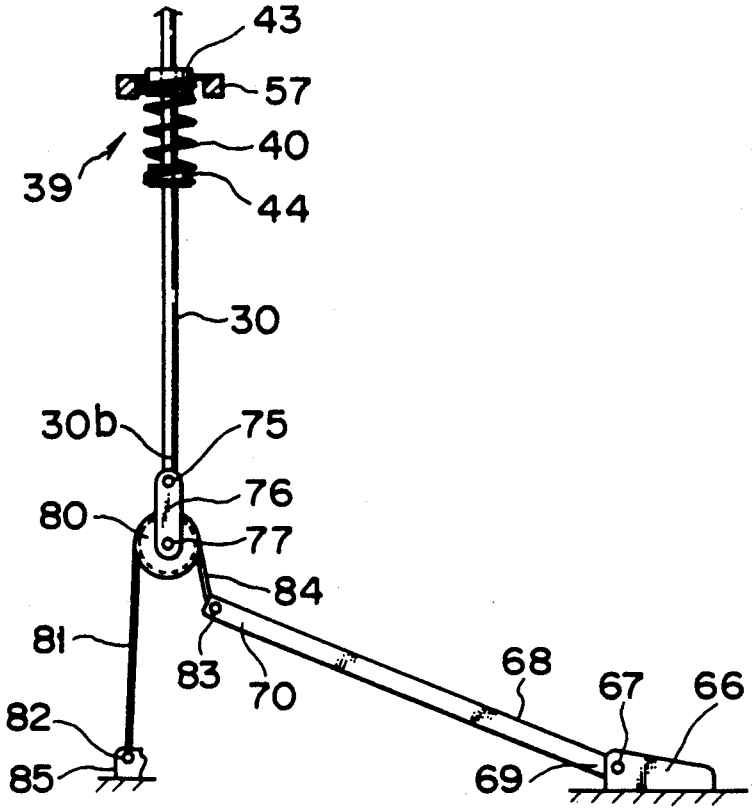
FIG. 4 is a side view showing part of the stand apparatus of FIG. 1.

If the player lifts his or her foot off the foot board 68, the elevator rod 30 is raised to the upper limit position shown in FIG. 4 by the elastic force of the return spring 40, so that the upper cymbal 12 is returned to its original height position. Since the spring constant of the return spring 40 used in the apparatus of this embodiment is greater than in the case of the conventional apparatus, the upper cymbal 12 can be returned more quickly. The force to raise the upper cymbal 12 can be adjusted by changing the height of the adjusting nut 57 of the return mechanism 39.

When the foot board 68 is worked, in the apparatus 11, the elevator rod 30 descends by a distance about half the movement of the end portion 70 of the board 68. If the distance H between the upper and lower cymbals 12 and 13 is the same as in the case of the conventional apparatus, therefore, the board 68 must be worked deeply. If the height of the cymbal fitting 32 is adjusted so that the distance H is shorter than in the case of the conventional apparatus, the upper cymbal 12 can be caused to strike against the lower cymbal 13 without deeply working the board 68.

Figure 6:
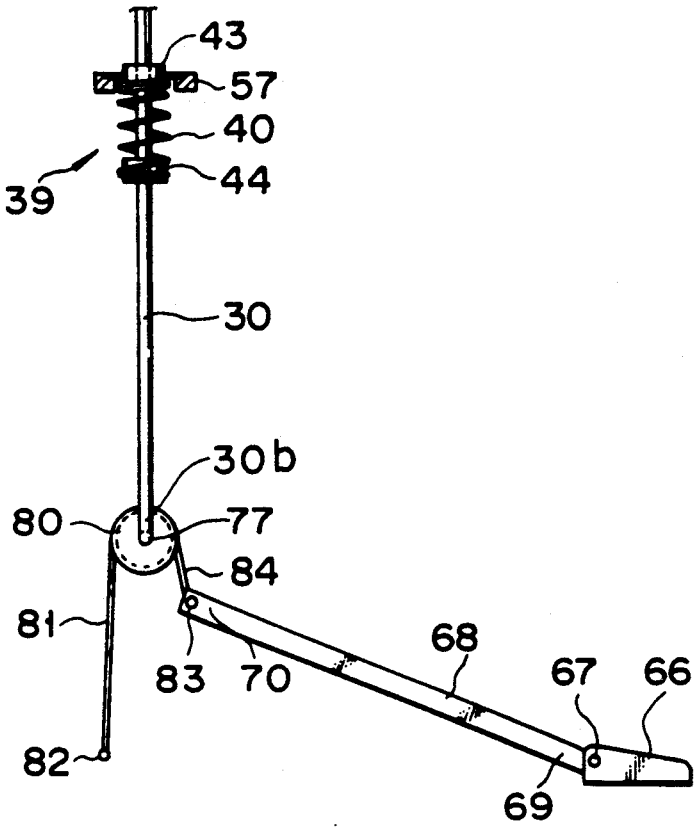
FIG. 6 is a side view showing a modification of the lower portion of an elevator rod.
Figure 7:
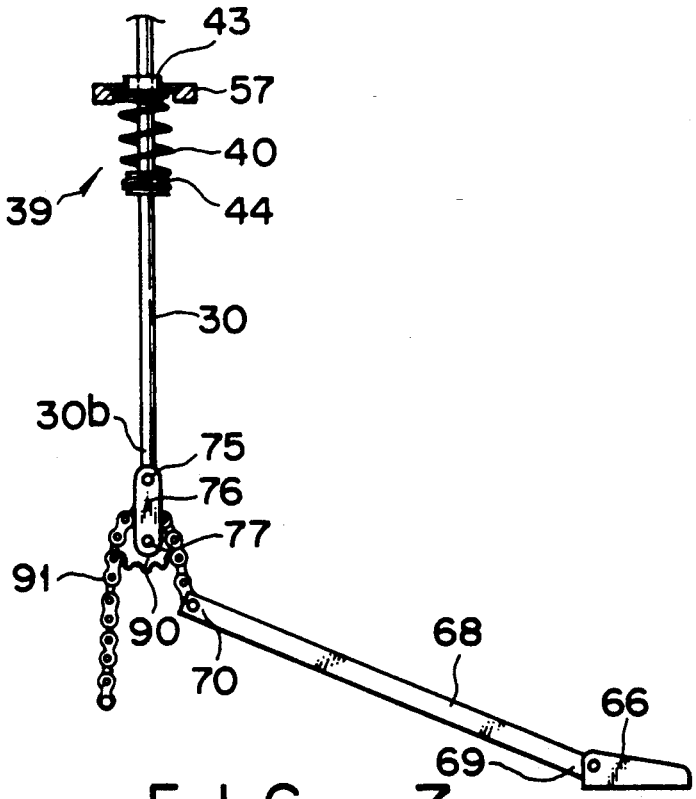
FIG. 7 is a side view showing a modified combination of a running guide member and a flexible member.

As shown in FIG. 6, the running guide member 80 may alternatively be mounted directly on the lower end portion 30*b* of the elevator rod 30. As shown in FIG. 7, moreover, a combination of a sprocket 90 and a chain 91 may be used for this purpose.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A hi-hat stand apparatus for supporting upper and lower cymbals facing each other, comprising:

a hollow post having an open upper end portion, an open lower end portion, and a through hole extending between the two end portions, the lower cymbal being mounted on the upper end portion of the post;

an elevator rod passed through the through hole of the hollow post, said rod having upper and lower end portions, said upper end portion of the rod projecting upward from the upper end portion of the hollow post and being fitted with the upper cymbal;

return means for urging the elevator rod to ascend;

stopper means for restraining the upper limit position of the elevator rod to prevent the rod ascend from ascending above a predetermined height;

a frame having a pair of vertically extending side wall portions and a horizontally extending portion;

a foot board having first and second end portions, said first end portion being supported by the horizontally extending portion of the frame, said second end portion being situated higher than the first end portion;

a horizontal support shaft situated between the pair of side wall portions of the frame and adapted to move in the vertical direction in association with the elevator rod;

a running guide member rotatably supported by means of the support shaft, said guide member being adapted to ascend and descend together with the elevator rod and situated higher than the second end portion of the foot board;

a flexible member having a fixed end, a free end, and an intermediate portion situated between the two ends, said free end being connected to the second end portion of the foot board, said intermediate portion being curved in the form of an inverted U and wound around the upper half of the running guide member; and supporting means for supporting the fixed end of the flexible member, said supporting means being situated lower than the running guide member and immovable with respect to the frame.

2. The hi-hat stand apparatus according to claim 1, wherein said return means includes a spring for upwardly urging the elevator rod and adjusting means for adjusting the force of the spring to urge the rod.

3. The hi-hat stand apparatus according to claim 1, wherein said return means includes a first retainer supported by the axially intermediate portion of the hollow post, a second retainer fixed to the axially intermediate portion of the elevator rod, a tension coil spring having first and second ends fixed to the first and second retainers, respectively, and adjusting means for adjusting the height of the first retainer relative to the hollow post.

4. The hi-hat stand apparatus according to claim 1, wherein said, flexible member and said running guide member comprise of a rope and a pulley, respectively.

5. The hi-hat stand apparatus according to claim 1, wherein said flexible member and said running guide member comprise of a belt and a pulley, respectively.

6. The hi-hat stand apparatus according to claim 1, wherein said flexible member and said running guide member comprise of a chain and a sprocket, respectively.

7. The hi-hat stand apparatus according to claim 1, wherein a link swingable back and forth is attached to the lower end portion of the elevator rod, said support shaft and said running guide member being provided at a lower portion of the link.

8. The hi-hat stand apparatus according to claim 1, wherein said elevator rod includes a cymbal fitting, said upper cymbal is supported on the elevator rod by means of the cymbal fitting capable of adjusting the distance between the upper and lower cymbals.

* * * * *

UNITED STATES PATENT AND TRADEMARK OFFICE

CERTIFICATE OF CORRECTION

PATENT NO. : 5,018,426

DATED : May 28, 1991

INVENTOR(S) : Seiji SUZUKI

It is certified that error appears in the above-identified patent and that said Letters Patent is hereby corrected as shown below:

Title page, Section [30] Foreign Application Priority Data:

Change Japanese Application No. "1-152969" to

-- 1-152969 [U] --.

Signed and Sealed this

Sixteenth Day of February, 1993

*Attest:*

STEPHEN G. KUNIN

*Attesting Officer*

*Acting Commissioner of Patents and Trademarks*